US005203561A

United States Patent [19]

Lanctot

[11] Patent Number: 5,203,561

[45] Date of Patent: Apr. 20, 1993

[54] VIBRATION DAMPENING HANDLE HAVING METAL PARTICLES AND A VISCUS FLUID

[76] Inventor: Paul A. Lanctot, 520 Sand Hill Rd., Scotts Valley, Calif. 95062

[21] Appl. No.: 865,176

[22] Filed: Apr. 8, 1992

[51] Int. Cl.[5] ..... A63B 53/14

[52] U.S. Cl. ..... 273/81 R; 273/81 A; 273/73 J

[58] Field of Search ..... 273/67 R, 67 DA, 72 R, 273/72 A, 75, 81 R, 81 A, 81 D, 170, 171, 84 R, 84 E

[56] References Cited

U.S. PATENT DOCUMENTS 3,075,768 1/1963 Karns ..... 273/81 A 4,541,631 9/1985 Sasse ..... 273/170

FOREIGN PATENT DOCUMENTS 0013337 of 1912 United Kingdom ..... 273/81 A

*Primary Examiner*—V. Millin

*Assistant Examiner*—William M. Pierce

*Attorney, Agent, or Firm*—Jeffrey A. Hall

[57] ABSTRACT

A golf club (10) having a grip (11), a shaft (12) and a clubhead (13). A tubular member (14) is positioned in the interior of the shaft (12) at substantially the grip portion (34) and has a first end (24) and a second end (25), said first end (24) having an opening (28) therein which is removably sealed with a plug (17). A hollow spine member (16) is secured within the tubular member (14) and is preferably attached to plug (17) and to the second end (25) of the tube member (14). A slurry (15) composed of a plurality of particles (26) and a fluid (27) is disposed within the tubular member (14). The tubular member (14) may be secured within said golf club by adhesives (30) or by mechanical fastening apparatus.

17 Claims, 2 Drawing Sheets

VIBRATION DAMPENING HANDLE HAVING METAL PARTICLES AND A VISCUS FLUID

BACKGROUND OF THE INVENTION

1. Field of Invention

This invention relates to golf clubs, particularly to golf clubs having means to dampen and isolate shock components generated as a result of the impact when the golf club strikes a ball, and to improve the performance and feel of the golf club.

2. Description of Prior Art

Golf clubs, baseball bats, racquets, paddles and clubs are all commonly used in various sports where the object is to strike a moving or stationary ball in order to propel it some distance. These devices have certain problems in common as well as common objectives. A primary problem is the generation of a shock as a result of the impact of the ball with the golf club, bat or racquet, etc., and the performance and feel of the implement on such impact.

In a golf club the shock generated is most severe when the ball impacts a point other than the optimum striking point or on the golf club. The "sweet spot" is the point where the most impact energy will be delivered to the ball and the club rebounds straight back and opposite to the ball's line of flight, and without any torquing, end for end, as rotation is developed. When this point is missed, some of the impact energy is delivered to the golf club, off center, which results in both uncomfortable and injurious levels of shock being transmitted through the golf club handle to the athlete. At best, this painful shock can rob the athlete of confidence, and at worst, it can cause serious injury while detracting from the performance and feel of tho golf club.

Heretofore a wide variety of golf clubs have been proposed and implemented which have attempted to improve performance and to dampen such shock and their consequences.

Golf club designs incorporating various weight distribution techniques are well known. An example of prior art weight distribution technique provides for making the head of the club lighter while adding compensating weight to the opposite end of the club in order to provide for a club having an overall weight distribution which is approximately the same as before the weight distribution was changed. Such weight distribution technique is premised primarily on the assumption that a lighter club head allows the golfer to swing the club with greater velocity and thereby increase the distance the ball will travel. Examples of this prior art are contained in U.S. Pat. No. 3,606,327 to Gorman, U.S. Pat. No. 4,165,874 to Lezatte et al., and the references cited therein. Another approach is disclosed in U.S. Pat. No. 4,674,746 to Benoit in which an additional weight in the form of a counterweight is added to the shaft above the pivot point of the golf club in order to increase the pendulum length of the golf club and position the center of percussion in the head of the golf club.

Another genre of golf club is disclosed in U.S. Pat. No. 4,541,631 to Sasse where a golf club having a hollowed head portion connected to a hollow shaft portion forms a sealed internal chamber. A flowable weight is placed in the chamber and regulated by a two way valve which allows the flowable weight to pass into the hollowed head portion by centrifugal force as the club is swung.

Still another type of golf club is disclosed in U.S. Pat. No. 3,075,768 to Karns in which a small sack or bag was disposed in the grip portion of a golf club handle and filled with a cushioning material and a solidifiable liquid or solid weighting means so as to improve balance and weighting of the club.

The primary problem with prior art shock absorbing and weight distribution techniques is that the weight was generally added to the wrong position in the golf club and the shock absorbing or dampening techniques were inadequate and actually deadened the effect of the ball, while providing little, if any relief from the shock component responsible for discomfort and injury.

It would be highly desirable therefore to provide a means and method to specifically reduce the shock generated by a golf club after striking a ball while improving the performance and feel of the golf club.

SUMMARY OF THE INVENTION

A golf club is disclosed comprising a grip, a shaft, and a clubhead. A tubular member is affixed within a grip portion of said shaft. The tubular member has a first end and a second end, said first end having an opening therein which is preferably sealed with a removable plug, said second end is preferably closed. A plurality of particles are interiorly disposed within said tubular member and surrounded by a fluid which is also interiorly situated within said tubular member. An elongated spine member is secured within said tubular member and is preferably centrally affixed to the center of the closed end of the tubular member.

The tubular member is preferably cylindrical in shape and may be composed of plastic, metal, rubber, urethane or the like.

The spine member is preferably composed of a soft compliant material which may be a fabric, plastic, rubber, urethane, or the like, so as to readily transfer shock to said particles and said fluid.

The particles may be of any shape, e.g. granular, flakes, particulate, etc., and may be composed of a metal, plastic, composite, or the like. The particles are combined in the tubular member with a viscous fluid, such as oil, and dampen shock components generated when the clubhead strikes a ball.

The present invention provides a golf club and a method of modifying existing golf clubs by use of the above so as to dampen and isolate both the torquing and lengthwise shocks generated by inaccurate hits while having essentially no effect on the third shock component which is perpendicular to the long axis of the club, and generally concentrated by weight distribution in the impact section of the club and parallel to the line of flight of the golf ball. Such third shock component, which is substantially unaffected in the instant invention, is primarily a direct consequence of the acceleration of the struck ball and cannot be attenuated without causing a proportional negative effect on the flight of the ball.

The present invention, by providing a golf club having a tubular member having an elongated spine extending therethrough, and having a slurry of particles and fluid therein, said tubular member being securely situated in the handle of the club, reacts specifically to high amplitude shocks delivered at the grip of the golf club and to any shock acting perpendicular to the shaft. This device does not adversely affect the flight of the golf ball, and improves both the performance and feel of the golf club.

Other advantages and a fuller understanding of the invention will be had by referring to the following description and claims of a preferred embodiment thereof taken in conjunction with the accompanying drawings wherein like reference numerals refer to similar parts throughout the several views.

DETAILED DESCRIPTION OF THE PREFERRED EMBODIMENT OF THE INVENTION

Although specific terms are used in the following description for the sake of clarity, these terms are intended only to refer to the particular structure of the invention elected for illustration and are not intended to define or limit the scope of the invention.

Figure 1:
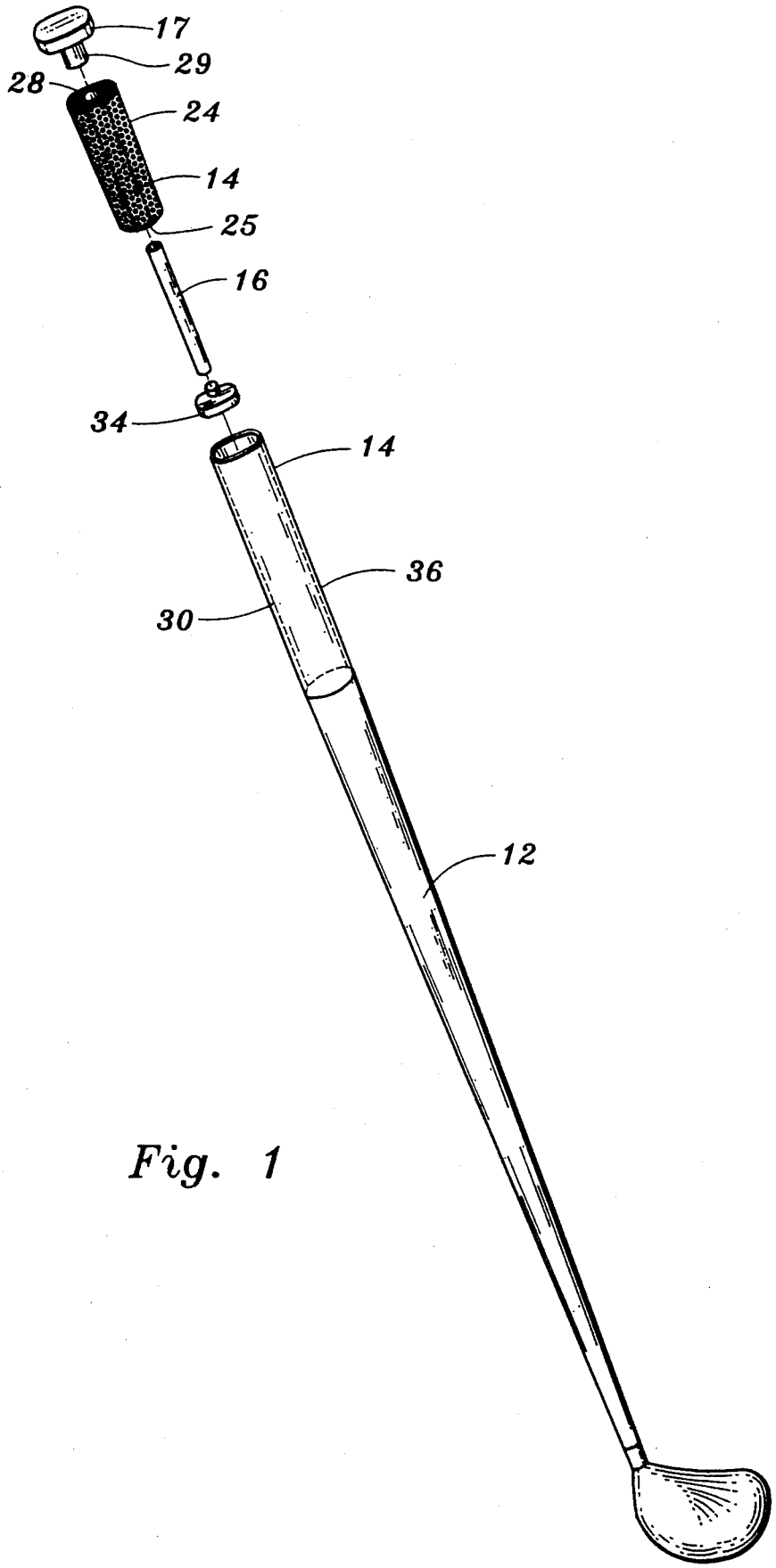
FIG. 1 is a side perspective view of a golf club showing the tube, slurry, and spine member separated from the club for illustrative purposes and constructed in accordance with the teachings of the present invention.

FIG. 1 shows a golf club according to the preferred embodiment of the invention. The golf club 10 comprises a grip 11, a shaft 12, and a clubhead 13. A tubular member 14 which is preferably cylindrical in shape and having a first end 24 having an opening 28, and a second end 25 which is preferably closed, is inserted into grip area 36 of shaft 12 of golf club 10. Tubular member 14 is preferably rigidly secured in shaft 12 by adhesives 30 and having a cap 34, but may be otherwise. Tubular member 14 preferably extends only into the grip area 30 of shaft 12 for optimal effect. An elongated spine member 16 is secured within tubular member 14. Spine member 16 is preferably centrally secured to said second end 25 of tubular member 14 by adhesives 30 and a compression nipple 29 and centrally to a plug 17 which is used to seal opening 28 of tubular member 14.

Figure 2:
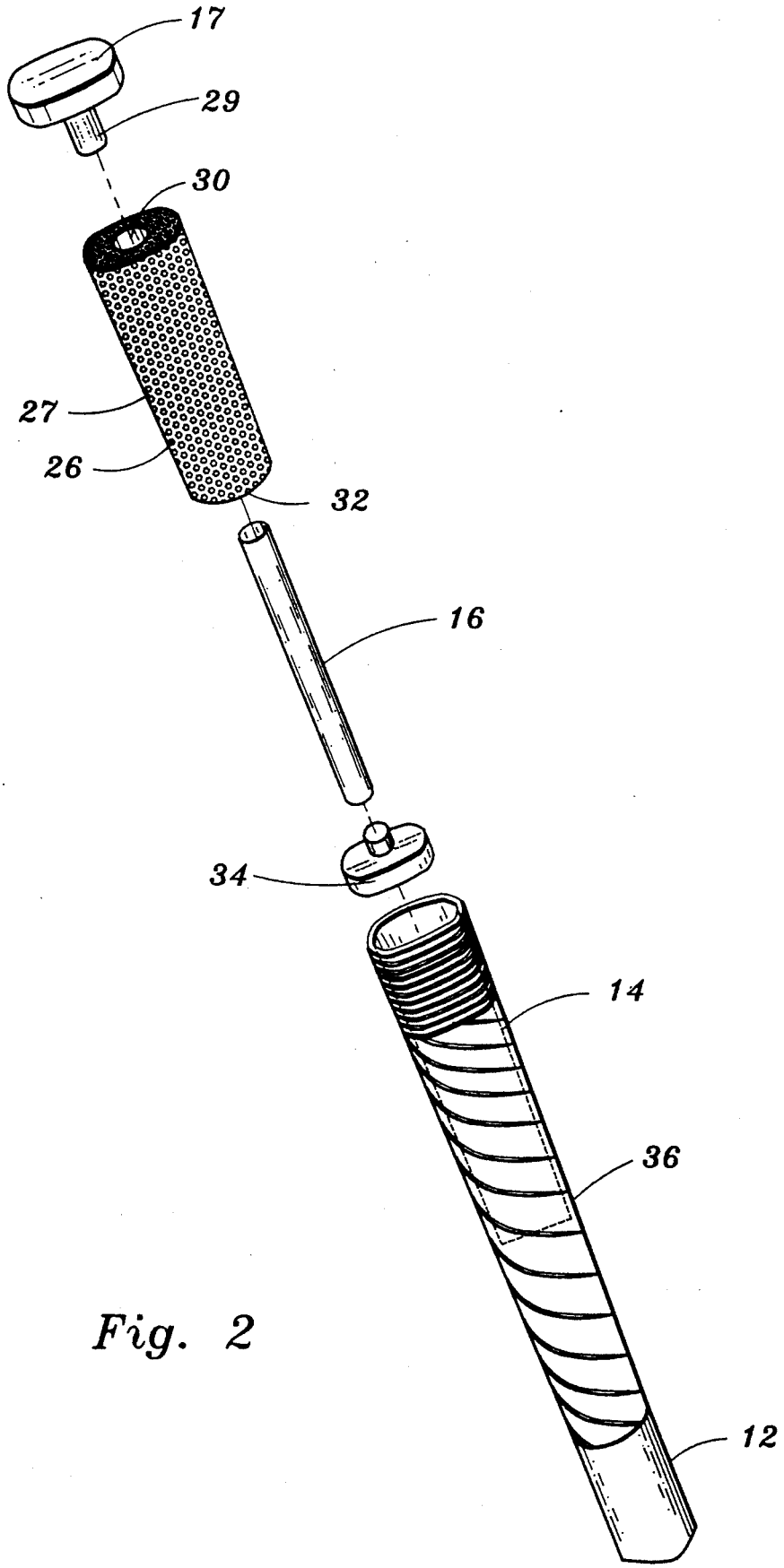
FIG. 2 is an enlarged partial, cross-sectional view corresponding to the grip area of the shaft of such golf club, according to the invention.

Referring to FIG. 2 spine 16 is preferably affixed to plug 17 by compression nipple 29 and adhesives 30. Spine 16 is, in the preferred embodiment, hollow, having space 32 therein. Spine 16 may be composed of rubber, plastic, or any compliant material, but is preferably composed of silicone rubber.

Tube 14 is filled with a slurry 15 composed of a plurality of particles 26 combined with a fluid 27. The plurality of particles 26 may be composed of metal, plastics, composites, or the like, or a combination of such materials, with lead shot being a preferred particle type. The fluid is preferably viscous such as oil, but any flowable liquid may be used as well as "jello-like" compositions. As an alternative embodiment, particles 26 and or spine 16 may be eliminated from tube 14, however, this results in some lessening of the dampening and noise reducing effect of the present invention and alters the feel and performance somewhat. Another embodiment encompasses the addition of a weight disposed within the grip area of the shaft for increasing performance.

As FIG. 2 illustrates, the tubular member 14, slurry 15, spine 16, and plug 17 may be easily retro-fitted onto existing golf clubs or manufactured as part of a new type of golf club.

In operation and use, golf club 10 has superior performance and feel and is very efficient at dampening shocks produced by inaccurate hits as well as enhancing a wide variety of other golfing functions such as golf club speed. It is believed that such advantages are achieved as herein described, however, no limitations on the scope or breadth of the present invention should be implied therefrom.

The means and methods herein described for the golf club of the present invention may also be installed in any implement subject to torquing shocks, for example, tennis racquets, baseball bats, racquets, carpenter's hammers, and the like. Furthermore, in addition to dampening shock components the present invention increases the speed, performance, and feel of the implement. In fact, an alternative embodiment encompasses the addition of a weight to the grip area of the implement for increasing speed and enhancing the feel and performance.

While the above description contains many specificities, they should not be construed as limitations on the scope of the invention but merely as exemplifications of preferred embodiments thereof. It is understood that the present disclosure has been made only by way of example and that numerous changes in the details of construction may be resorted to without departing from the spirit and scope of the invention. Accordingly the scope of the invention should be determined by the appended claims and their legal equivalents, and not by the examples which have been given.

I claim:

1. A golf club comprising:

a clubhead, a shaft, and a grip, a tubular member inserted into said shaft of said golf club, having a first end and a second end, said first end having an opening therein, a hollow spine member secured within said tubular member, a plurality of particles interiorly disposed within said tubular member, a viscous fluid interiorly situated within said tubular member, and means for sealing said opening in said first end of said tubular member.

2. The golf club of claim 1 wherein said tubular member is secured within said shaft by adhesives.

3. The golf club of claim 1 wherein said tubular member is composed of metal.

4. The golf club of claim 1 wherein said spine member is composed of silicone rubber.

5. The golf club of claim 1 wherein said spine member is composed of plastic.

6. The golf club of claim 1 wherein said spine member is centrally secured to said second end of said tubular member by a compression nipple and extends lengthwise through said tubular member.

7. The golf club of claim 1 wherein said plurality of particles are composed of metal.

8. The golf club of claim 1 wherein said plurality of particles are composed of plastic.

9. The golf club of claim 1 wherein said fluid is an oil.

10. The golf club of claim 1 wherein said means for sealing said opening in said first end of said tubular member comprises a plug.

11. In a golf club having a clubhead, a shaft, and a grip, the improvement comprising a tubular member inserted into said shaft of said golf club having a first end and a second end, said first end having an opening therein, an elongated hollow tube spine member secured within said tubular member, a plurality of particles interiorly disposed within said tubular member, a viscous fluid dispersed within said tubular member and in contact with said plurality of particles, and means for sealing said opening in said first end of said tubular member.

12. The golf club of claim 11 wherein said tubular member is a cylinder of plastic.

13. The golf club of claim 11 wherein said tubular member is secured within said shaft by adhesives.

14. The golf club of claim 11 wherein said spine member is composed of silicone rubber.

15. The golf club of claim 11 wherein said plurality of particles are composed of metal.

16. The golf club of claim 11 wherein said fluid is an oil.

17. The golf club of claim 1 wherein said means for sealing said opening in said first end of said tubular member comprises a plug.

* * * * *